US009089951B2

(12) United States Patent
Bao et al.

(10) Patent No.: US 9,089,951 B2
(45) Date of Patent: Jul. 28, 2015

(54) FINE POLYCRYSTALLINE DIAMOND COMPACT WITH A GRAIN GROWTH INHIBITOR LAYER BETWEEN DIAMOND AND SUBSTRATE

(75) Inventors: Yahua Bao, Orem, UT (US); Scott L. Horman, Lindon, UT (US)

(73) Assignee: Element Six Limited, County Clare (IE)

( * ) Notice: Subject to any disclaimer, the term of this patent is extended or adjusted under 35 U.S.C. 154(b) by 517 days.

(21) Appl. No.: 13/592,452

(22) Filed: Aug. 23, 2012

(65) Prior Publication Data

US 2013/0048389 A1 Feb. 28, 2013

Related U.S. Application Data

(60) Provisional application No. 61/526,562, filed on Aug. 23, 2011.

(51) Int. Cl.

| | |
|---|---|
| ***E21B 10/46*** | (2006.01) |
| ***E21B 10/55*** | (2006.01) |
| ***B24D 99/00*** | (2010.01) |
| ***B24D 18/00*** | (2006.01) |
| ***B22F 3/14*** | (2006.01) |
| ***B22F 7/06*** | (2006.01) |
| ***C22C 26/00*** | (2006.01) |
| *B22F 5/00* | (2006.01) |

(52) U.S. Cl.

CPC ..... *B24D 99/005* (2013.01); *B22F 3/14* (2013.01); *B22F 7/06* (2013.01); *B24D 18/0009* (2013.01); *C22C 26/00* (2013.01); *E21B 10/46* (2013.01); *E21B 10/55* (2013.01); *B22F 2005/001* (2013.01)

(58) Field of Classification Search

CPC ... E21B 10/46; E21B 10/55; E21B 2010/561; E21B 2010/565; E21B 10/5735; C22C 29/08; C22C 2026/006; C22C 29/10

See application file for complete search history.

(56) References Cited

U.S. PATENT DOCUMENTS

| | | | | |
|---|---|---|---|---|
| 4,764,434 | A * | 8/1988 | Aronsson et al. | 428/565 |
| 2009/0226688 | A1 | 9/2009 | Fang | |
| 2010/0126779 | A1 | 5/2010 | Corbett et al. | |
| 2012/0037431 | A1 * | 2/2012 | DiGiovanni et al. | 175/428 |

FOREIGN PATENT DOCUMENTS

WO 2010/117823 A1 10/2010

OTHER PUBLICATIONS

International Search Report for PCT/US/051985 dated Nov. 12, 2012.

* cited by examiner

*Primary Examiner* — Cathleen Hutchins
(74) *Attorney, Agent, or Firm* — Bryan Cave LLP

(57) ABSTRACT

Polycrystalline diamond compacts for cutting tools and rock drilling tools, and more particularly to very fine polycrystalline diamond compacts with a grain growth inhibitor layer and reduced abnormal grain growth. A method of fabricating such polycrystalline diamond material includes placing a powder layer of nano-sized grain growth inhibitor particles next to a mixture of diamond particles having an average particle size of about 1 micron or less and sintering at high pressure and high temperature to create a polycrystalline structure of sintered diamond grains. The sintered diamond grains have an average size of about 1 micron or less.

20 Claims, 6 Drawing Sheets

FINE POLYCRYSTALLINE DIAMOND COMPACT WITH A GRAIN GROWTH INHIBITOR LAYER BETWEEN DIAMOND AND SUBSTRATE

CROSS-REFERENCE TO RELATED APPLICATION

The above referenced application claims priority to and is based upon U.S. Provisional Application No. 61/526,562, filed on Aug. 23, 2011, the contents of which are fully incorporated herein by reference.

BACKGROUND

The present invention relates to polycrystalline diamond compacts for cutting tools, and more particularly to very fine polycrystalline diamond compacts with a grain growth inhibitor layer and reduced abnormal grain growth.

Sintered polycrystalline diamond material is known for its good wear resistance and mechanical strength, and is often used in cutting tools and rock drilling tools. To form polycrystalline diamond (PCD), diamond particles are sintered at high pressure and high temperature (HPHT sintering) to produce an ultra-hard polycrystalline structure. A catalyst material such as cobalt or another metal may be added to the diamond particle mixture prior to sintering and/or may infiltrate the diamond particle mixture during sintering in order to promote the intergrowth of the diamond crystals during HPHT sintering. The resulting PCD structure includes a network of interconnected diamond crystals or grains bonded to each other, with the catalyst material occupying the spaces or pores between the bonded diamond crystals. The diamond particle mixture may be HPHT sintered in the presence of a substrate, to form a PCD compact bonded to the substrate.

Ultra-fine PCD, such as PCD with sintered diamond grains on the order of about 1 micron in size or less, is known for its superior mechanical properties and performance. However, ultra-fine sintered PCD is difficult to create, due to the small size of the diamond particles. The very small diamond particles have a large ratio of surface area to volume, and this large surface area to volume ratio can cause abnormal grain growth of the diamond crystals during sintering. In particular, during HPHT sintering, very fine diamond particles may interconnect and grow into very large diamond grains, growing to sizes many times greater than the size of the original diamond particles in the powder mixture. As a result, the sintered material is not uniform, as the PCD structure is interrupted by areas of large, abnormal grain growth. This disparity in grain size and the lack of uniform polycrystalline structure degrade the performance and material characteristics of the sintered PCD material. It has been difficult to achieve a uniform polycrystalline structure with a very fine diamond particle mixture, such as an average particle size of 0.5 micron or less. At this size or below, abnormal grain growth is common after HPHT sintering.

Accordingly, it is known to provide a grain growth inhibitor with the diamond particle mixture in order to limit the growth of large, abnormal diamond crystals during HPHT sintering. During HPHT sintering, the grain growth inhibitor occupies space at the boundaries between diamond particles and prevents the particles from growing together into larger grain sizes. The grain growth inhibitor may be physically blended with the diamond particles prior to sintering, or may be deposited by physical vapor deposition (PVD) or chemical vapor deposition (CVD).

However, abnormal grain growth continues to be observed in PCD with ultra-fine diamond grains, in particular along the boundary between the PCD and the substrate. Accordingly, there is still a need for an ultra-fine sintered PCD compact with reduced abnormal grain growth, and a method for fabricating the same.

SUMMARY

The present disclosure relates to polycrystalline diamond compacts for cutting tools and rock drilling tools, and more particularly to very fine polycrystalline diamond compacts with a grain growth inhibitor layer and reduced abnormal grain growth. In one embodiment, a method of fabricating an ultra-fine PCD material with uniform sintered grain size is provided. The method includes providing a mixture of ultra-fine diamond particles, and in one embodiment the diamond particles are less than 1 micron in size, such as less than 0.5 micron in size. The method then includes uniformly distributing a layer of grain growth inhibitor in loose powder form over the diamond particle mixture. The grain growth inhibitor may be a titanium-containing particle such as TiCN, TiN, and/or TiC, and the particles of the grain growth inhibitor are on the order of 500 nanometers in size, or smaller, such as 100 nanometers in size or smaller. The method then includes placing a substrate over the grain growth inhibitor powder layer, and then HPHT sintering the three components, to produce a sintered PCD structure with uniform diamond crystal grain size, bonded to the substrate.

In one embodiment, a method of fabricating a polycrystalline diamond material includes placing a powder layer of nano-sized grain growth inhibitor particles next to a mixture of diamond particles. The mixture of diamond particles has an average particle size of about 1 micron or less. The method also includes placing a substrate next to the powder layer, and sintering the mixture of diamond particles and the powder layer of grain growth inhibitor particles at high pressure and high temperature to create a polycrystalline structure of sintered diamond grains. The sintered diamond grains have an average size of about 1 micron or less.

In one embodiment, a polycrystalline diamond compact includes a polycrystalline diamond body having a material microstructure that has a plurality of bonded-together diamond grains and interstitial regions between the diamond grains. The compact also includes a substrate having tungsten carbide and a catalyst metal, and a grain growth inhibitor layer between the polycrystalline diamond body and the substrate. The grain growth inhibitor layer includes a plurality of titanium-containing particles interspersed with tungsten and the catalyst metal. The titanium-containing particles are less than 800 nanometers in size. The grain growth inhibitor layer is bonded to the substrate and to the polycrystalline diamond body at opposite sides, and is about 20-100 microns in thickness. The sintered diamond grains have an average size of about 1 micron or less.

DETAILED DESCRIPTION

The present disclosure relates to polycrystalline diamond compacts for cutting tools and rock drilling tools, and more particularly to very fine polycrystalline diamond compacts with a grain growth inhibitor layer and reduced abnormal grain growth. In one embodiment, a method of fabricating an ultra-fine PCD material with uniform sintered grain size is provided. The method includes providing a mixture of ultra-fine diamond particles, and in one embodiment the diamond particles are less than 1 micron in size, such as less than 0.5 micron in size. The method then includes uniformly distributing a layer of grain growth inhibitor in loose powder form over the diamond particle mixture. The grain growth inhibitor may be a titanium-containing particle such as TiCN, TiN, and/or TiC, and the particles of the grain growth inhibitor are on the order of 500 nanometers in size, or smaller, such as 100 nanometers in size or smaller. The method then includes placing a substrate over the grain growth inhibitor powder layer, and then HPHT sintering the three components, to produce a sintered PCD structure with uniform diamond crystal grain size, bonded to the substrate.

Throughout the disclosure and claims, references to carbon nitrides, nitrides, and carbides such as TiCN, TiN, and TiC include stoichiometric as well as non-stoichiometric compounds. That is, these compounds include compounds with a 1:1 ratio of the elements, as well as other ratios. For example, references to TiN include $TiN_x$, where $0<x\leq1$. References to TiC include $TiC_x$, where $0<x\leq1$. References to TiCN include $TiC_xN_y$, where $0<x\leq1$ and $0<y\leq1$.

Figure 1:
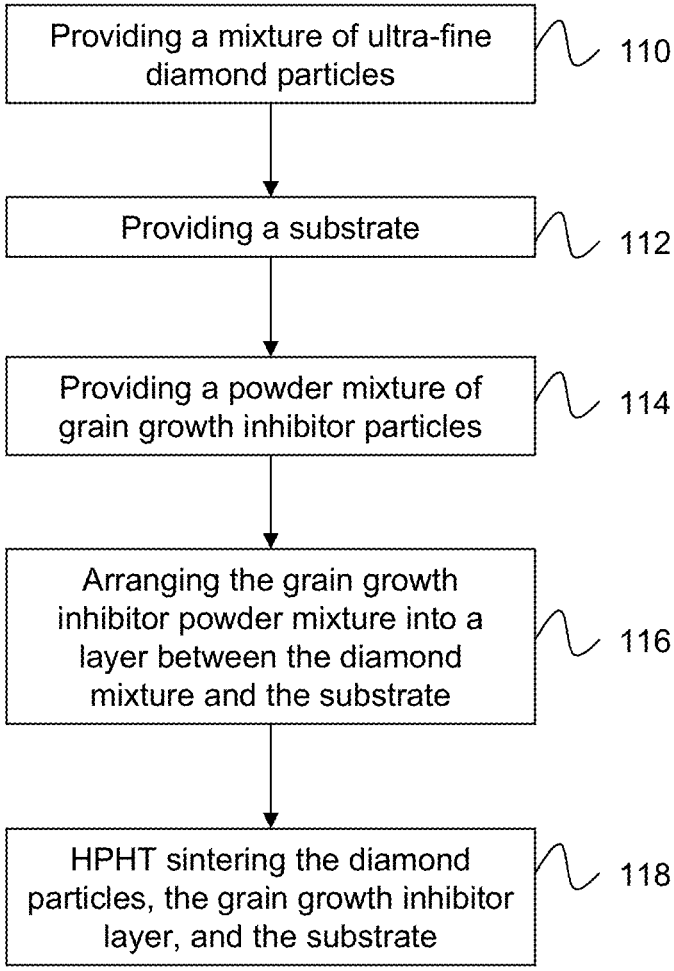
FIG. 1 is a flowchart showing a method of fabricating an ultra-fine PCD material with uniform sintered grain size according to an embodiment of the present disclosure.

A method for fabricating an ultra-fine PCD material with reduced abnormal grain growth according to an embodiment of the present disclosure is shown in FIG. 1. In accordance with this embodiment, the method includes providing a mixture of ultra-fine diamond particles 110. As used herein, references to "ultra-fine" diamond particle mixtures include mixtures with an average particle size of about 1 micron or less. In one embodiment, the ultra-fine diamond particle mixture includes an average particle size that is even smaller, such as about 0.5 micron or less. The diamond particle mixture includes a uniform distribution of a blend of particles in the size range, such as a blend of particles ranging in size from 0 to 0.5 micron, and in another embodiment from 0 to 1 micron, and in another embodiment from 0.5 to 1 micron. The diamond particle mixture is provided in powder form, with the various diamond particles uniformly blended together.

As shown in FIG. 1, the method also includes providing a substrate 112, and providing a powder mixture of grain growth inhibitor particles 114. The substrate may be a cemented tungsten carbide disc, which will be bonded to the PCD layer during HPHT sintering to provide a support for the sintered PCD compact. The substrate also provides a source of the catalyst material that infiltrates into the PCD layer during sintering, to promote the bonding of the diamond particles through diamond crystal growth. The grain growth inhibitor mixture includes nano-sized particles of TiC, or TiCN, or TiN, or combinations of these, with a size of about 500 nm or less, or in some embodiments 200 nm or less, or in some embodiments 100 nm or less, in a uniform distribution, as described in more detail below. In one embodiment, the grain growth inhibitor mixture includes particles with a size of about 800 nanometers or smaller.

Figure 4A:
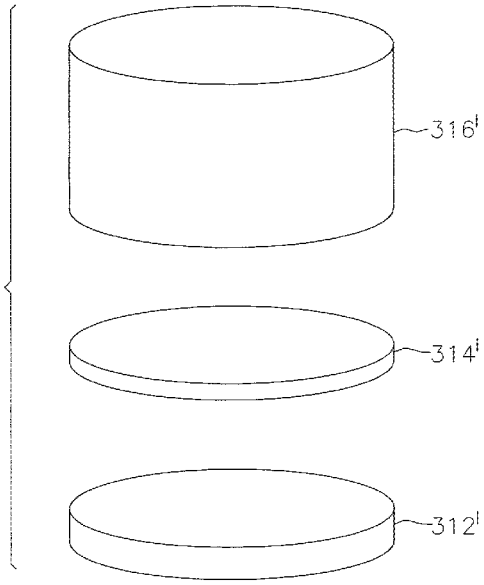
FIG. 4A shows a perspective view of a substrate, a diamond powder mixture, and a grain growth inhibitor layer, prior to sintering, according to an embodiment of the present disclosure (with dimensions exaggerated and not to scale, for clarity).

Next, the method includes arranging the grain growth inhibitor powder into a uniform layer between the diamond mixture and the substrate, 116. This can be done by first arranging the ultra-fine diamond powder mixture into a flat, uniform layer in a refractory metal can. The layer of diamond particles may have a thickness in the range of about 1 mm to 1.5 mm. Next, the powder layer of grain growth inhibitor particles is weighed and then spread above the diamond particle mixture. This powder layer is also arranged into a flat, uniform layer, having a thickness in the range of about 80 microns to 100 microns. The grain growth inhibitor powder may be provided as a loosely compacted disc of powder. Both of these powder layers, the diamond and the grain growth inhibitor, are carefully weighed to provide the desired amounts of each. The substrate is placed above the grain growth inhibitor layer. These three components are shown in FIG. 4A, with dimensions exaggerated for clarity (not to scale). FIG. 4A shows the diamond powder mixture 312', below the grain growth inhibitor powder layer 314', below the substrate 316' (the prime indicates prior to sintering). These three components are arranged in this order in a refractory metal can for HPHT sintering. These three components may be also arranged in the opposite order.

Optionally, the grain growth inhibitor powder layer and the diamond layer may be partially or lightly compacted prior to HPHT sintering, in order to promote a uniform microstructure in the diamond layer, and to uniformly spread the grain growth inhibitor powder layer over the diamond layer. Compaction may be provided by placing the powder layers into a hydraulic press under about 100 MPa. After such compaction, the powder grain growth inhibitor layer may have a density between about 30-70% of theoretical density, for example around 55% of theoretical density. The particles in the grain growth inhibitor layer remain discrete from each other, contacting each other but not solidly bonded to each other or to any adjacent layer. Prior to sintering, the grain growth inhibitor particles are not chemically bonded to each other or to any adjacent layer. The grain growth inhibitor particles are not joined together in a solid coating or a film, and are not adhered to each other. Although the particles themselves may clump together due to weak interactions between the particles (such as, for example, van der Waals forces), the particles are not bonded together. The interaction and contact between the particles is limited to that which results from mixing and compaction of the loose powder material.

Figure 4B:
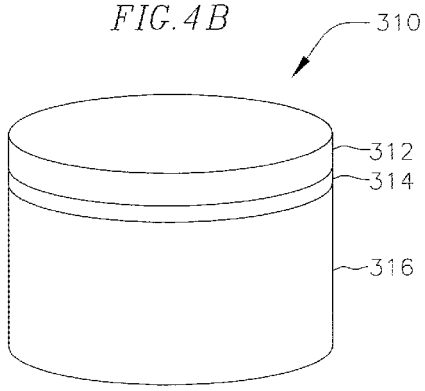
FIG. 4B shows a sintered PCD compact according to an embodiment of the present disclosure.

Referring again to FIG. 1, the method then includes HPHT sintering the three components 118—the diamond powder mixture, the grain growth inhibitor layer, and the substrate. In one embodiment, HPHT sintering comprises pressing the components at a pressure in the range of 5 to 8 GPa at an elevated temperature in the range of 1300-1650° C. In one embodiment, the pressure is raised to the full sintering pressure (5 to 8 GPa), and then subsequently the heat is raised to the sintering temperature (1300-1650° C.), while the high pressure is maintained. Sintering occurs at this high temperature. After sintering, the press is cooled, and then the pressure is released. The resulting sintered diamond compact 310 is shown in FIG. 4B, with the sintered PCD layer 312 bonded to the sintered substrate 316 with the sintered grain growth inhibitor layer 314 at the interface between the substrate and the PCD layer.

A catalyst material may be added to the diamond mixture before placement of the grain growth inhibitor layer. For example, the diamond particles may be coated with cobalt particles (as the catalyst material) by a wet chemical method prior to blending the grain growth inhibitor. It should be understood that the grain growth inhibitor material is not the same as the catalyst material that promotes the formation of the PCD structure.

The powder layer of grain growth inhibitor particles 304 between the diamond particles and the substrate inhibits abnormal grain growth at the interface between the diamond layer and the substrate. Very fine diamond particles are prone to abnormal grain growth along the interface between the diamond particles and the substrate. During sintering, metal from the substrate, such as cobalt, liquefies under the high heat and pressure and flows from the substrate into the diamond powder layer. The flowing cobalt metal from the substrate creates a cobalt-rich zone along the interface between the substrate and the diamond powder layer. The large amount of cobalt in this area wets the diamond particles and promotes the formation of new diamond crystals during sintering, and can result in rapid, abnormal diamond grain growth, forming very large diamond grains.

In embodiments, the powder layer of grain growth inhibitor particles between the substrate and the diamond particles acts as a barrier layer and slows the rate of infiltration of the liquid cobalt flowing into the diamond layer, preventing a large initial accumulation of liquid cobalt in the diamond region near the interface. The grain growth inhibitor particles are arranged in a powder layer that slows the flow of liquid cobalt but does not completely block the flow. The liquid cobalt moves through the grain growth inhibitor layer and slowly infiltrates into the diamond powder mixture, at a slower and more controlled rate. At this slower rate of diffusion, the diamond particles sinter together in a more controlled manner, as they are each individually wetted by the liquid cobalt. As these individual diamond particles are wetted and fused, other diamond particles nearby may not yet be fully wetted by the liquid cobalt, and thus they are less likely to fuse together. As a result, rapid grain growth among these particles is avoided. Also, the growth of diamond grains occurs at a lower relative percentage of cobalt, as compared to sintering without the grain growth inhibitor layer. As a result, the diamond grains grow more uniformly, and rapid abnormal grain growth is reduced.

Thus the layer of grain growth inhibitor particles slows the flow of the liquid catalyst from the substrate, while the powder arrangement of this layer still allows the catalyst to flow through the layer into the diamond mixture to promote the controlled growth of normal diamond grains. In an embodiment, the grain growth inhibitor is provided as a powder layer, not a fully dense layer or a solid coating such as a coating provided by PVD or CVD. Instead, it is put in place as a mixture of discrete particles in powder form, rather than a bonded solid layer. In the powder layer, the particles contact each other, and as the pressure is raised, they may become crushed or deformed against each other. However, they are not chemically bonded together. Also, the grain growth inhibitor powder layer is provided separately from the substrate and from the diamond layer, rather than being bonded to either of those layers.

The grain growth inhibitor powder layer may be pre-mixed with a binder to aid in uniformly spreading the powder over the diamond layer. Examples of a binder include paraffin wax, polyethylene glycol, and other common organic binders used with ceramic powders. However, in other embodiments, no binder or other additives are included with the grain growth inhibitor layer prior to sintering, and the grain growth inhibitor layer is made up entirely of the grain growth inhibitor particles, with no other components. In one embodiment, the grain growth inhibitor powder layer is devoid of any ultra-hard particles such as diamond or cubic boron nitride (CBN).

In addition to slowing the rate of flow of the liquid cobalt into the diamond layer, the grain growth inhibitor particles also reduce abnormal grain growth by moving into the diamond layer. The grain growth inhibitor particles are partially dissolved into the liquid cobalt phase during HPHT sintering. The liquid cobalt carries the partially dissolved and non-dissolved grain growth inhibitor particles with it into the diamond layer. As a result, the cobalt flowing into the diamond is rich in titanium carbide or similar grain growth inhibitor material. The presence of titanium (or other ceramic materials) with the diamond and cobalt is known to reduce rapid grain growth among the diamond grains.

In one embodiment, the grain growth inhibitor particles are nano-sized (defined further below) titanium-containing particles, arranged into a uniform powder layer of about 50-100 microns in thickness, for example about 80-100 microns or about 50-60 microns in thickness (prior to sintering). In one embodiment, the grain growth inhibitor layer is at most 500 microns in thickness, and in another embodiment, it is no less than 10 microns in thickness. The grain growth inhibitor layer may have a thickness in the range of 10-500 microns, such as about 40-100 microns, or about 50-60 microns. The thickness of the grain growth inhibitor layer may be varied based on the cobalt content of the substrate. In one embodiment, the cobalt content of the substrate is about 14%, and the grain growth inhibitor layer (prior to sintering) has a thickness of about 10-500 microns, or 40-100 microns, or 50-60 microns. The layer should have a thickness sufficient to effectively control the flow of catalyst (such as cobalt) from the substrate into the diamond layer.

The titanium-containing particles may be titanium carbide (TiC), titanium carbon nitride ($TiC_xN_y$), or titanium nitride (TiN). In each case, the titanium-containing particles are arranged into a homogenous, uniform powder mixture, and this loose powder mixture is then spread out over the diamond mixture prior to sintering. In one embodiment, the powder mixture is limited to only one type of titanium-containing powder, such as only TiC or only $TiC_xN_y$ or only TiN. In other embodiments, the powder mixture may contain a blend of these particles (TiC and/or $TiC_xN_y$ and/or TiN). Additionally, in other embodiments, instead of titanium-containing particles, other carbide, carbon-nitride, or nitride families may be used as the grain growth inhibitor, such as the carbides, nitrides, and carbon-nitrides of all Group IVB, VB, and VIB metals on the periodic table, namely, Ti, V, Cr, Zr, Nb, Mo, Hf, Ta, and W. Throughout this disclosure, where titanium is identified, it should be understood that any one of these metals may be provided. These carbides, carbon-nitrides, and nitride families (of Group IVB, VB, and VIB metals) are collectively referred to as the grain-growth inhibitor particles.

In one embodiment, the grain growth inhibitor powder mixture is limited to only the carbide, carbon-nitride, or nitride particles. That is, the powder mixture is a homogeneous mixture of only these particles. For example, in one embodiment, the powder mixture is limited to titanium-containing particles. That is, the only particles that are included in the grain growth inhibitor powder mixture provided prior to sintering are titanium-containing particles such as TiC or $TiC_xN_y$ or TiN.

In one embodiment, the average size of the particles of the grain growth inhibitor is smaller than the average diamond particle size. In one embodiment, substantially all of the particles of the grain growth inhibitor are smaller than the average diamond particle size, and in another embodiment smaller than substantially all of the diamond particles. In one embodiment, the grain growth inhibitor particles are about the same as or smaller than the average diamond particle size. In another embodiment, the grain growth inhibitor particles are less than (such as about an order of magnitude less than) the average diamond particle size. In another embodiment the diamond particles are about 1 micron or less in size, such as about 0.5 micron or less, and the grain growth inhibitor particles are approximately 100 nanometers or less in size. In another embodiment the grain growth inhibitor particles range in size between about 10 to about 200 nanometers, with the average particle size being about 50 nanometers. As used herein, the term "nano-sized" means between about 1-500 nanometers in size, such as, for example, about 200 nanometers or less, or 100 nanometers or less, or for example around approximately 50 nanometers in size. These small particles have a relatively large surface area, which helps control the flow of cobalt through the grain growth inhibitor layer. In another embodiment, the grain growth inhibitor particles could be larger, such as up to 800 nanometers in size, or up to 1 micron.

Figures 3A, 3B:
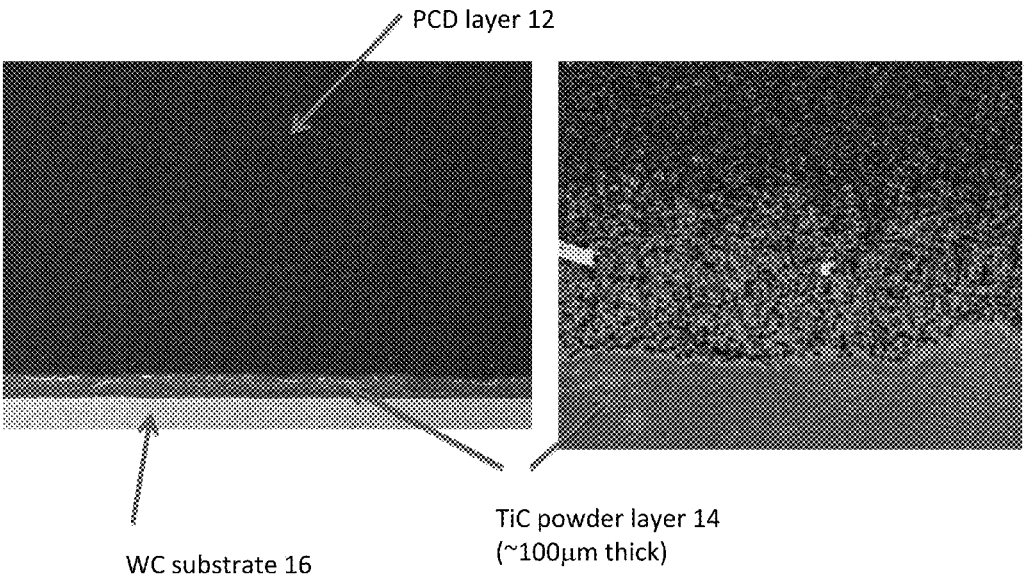
FIGS. 3A-3D show magnified cross-sectional views (with increasing magnification) of a sintered PCD compact with uniform sintered grain size, according to an embodiment of the present disclosure.
Figure 3C:
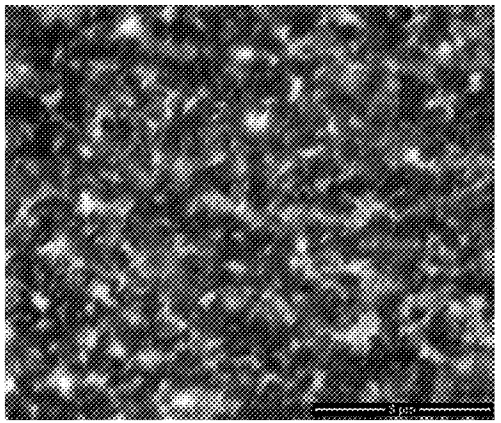

An ultra-fine PCD body was fabricated according to the method of FIG. 1, and the results are shown in FIGS. 3A-C. FIG. 3A shows a magnified cross-sectional view of a sintered PCD compact, according to an embodiment of the present disclosure. As shown in FIG. 3A, the sintered structure includes a PCD layer 12, a grain growth inhibitor layer 14, and a tungsten carbide (WC) substrate 16. The grain growth inhibitor layer 14 is between the other two layers. FIGS. 3B and 3C show the same structure at greater magnifications.

In this example, the diamond powder mixture included an average particle size less than 0.5 microns. Titanium carbide (TiC) particles were used as the grain growth inhibitor. Prior to sintering, the grain growth inhibitor layer was arranged as a uniform powder layer of the TiC particles. After sintering, this layer includes TiC particles as well as some cobalt and tungsten carbide which diffused into the layer 14 from the substrate 16. After sintering, the grain growth inhibitor layer 14 is about 60-70 microns in thickness. In one embodiment, the grain growth inhibitor layer is compressed during sintering, and decreases in thickness during sintering by about 40%. Thus, in one embodiment, the grain growth inhibitor layer is about 100 microns in thickness prior to sintering, and is about 60-70 microns in thickness after sintering. In other embodiments the grain growth inhibitor layer is about 20-100 microns in thickness after sintering.

Figure 2:
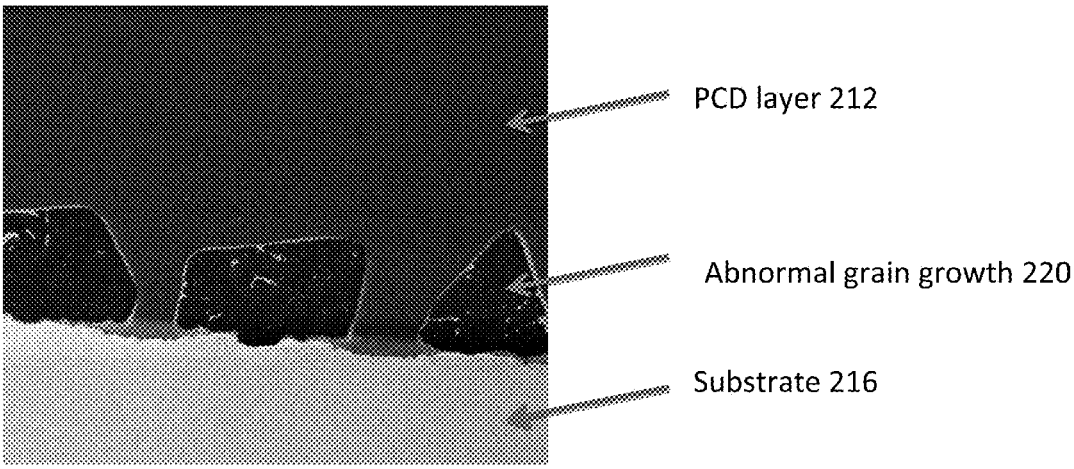
FIG. 2 shows a magnified cross-sectional view of a sintered PCD material with abnormal grain growth.

As shown in FIGS. 3A-3C, the sintered PCD layer 12 includes a uniform structure, substantially free of abnormal diamond grain growth, and with no visible agglomerations of the grain growth inhibitor particles that are on the same scale as the diamond crystals. For comparison, a PCD material with abnormal grain growth is shown in FIG. 2. FIG. 2 shows a PCD layer 212 bonded to a tungsten carbide substrate 216. Along the interface between the PCD layer and the substrate, the PCD microstructure includes large regions of abnormal grain growth 220. These abnormal diamond grains are substantially larger in size than the size of the surrounding diamond crystals.

Figure 3D:
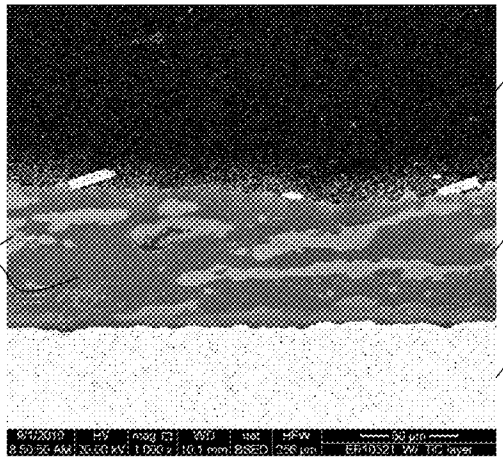

FIG. 3D shows a magnified view of the grain growth inhibitor layer 14 after sintering. The sintered grain growth inhibitor layer includes regions 14A rich in tungsten and cobalt between the regions 14B rich in titanium-containing particles and cobalt. Cobalt and tungsten from the substrate diffuse into and through the grain growth inhibitor layer during HPHT sintering, and some of these particles may remain trapped within the grain growth inhibitor layer between the grain growth inhibitor particles. Because the grain growth inhibitor layer is provided initially as a powder layer, the cobalt and tungsten from the substrate are able to pass through this layer, resulting in a sintered layer 14 that is interspersed with tungsten and cobalt (or other catalyst metal). In one embodiment, the tungsten and cobalt (or other catalyst metals) are evenly dispersed throughout the sintered layer 14. When TiC is used as the grain growth inhibitor, the sintered grain growth inhibitor layer forms cobalt cemented TiC—WC. In one embodiment, this sintered layer 14 has a thickness of about 20-100 microns, and in another embodiment about 50-70 microns.

In one embodiment, the sintered grain growth inhibitor layer (that is, the layer after HPHT sintering) includes about 1-25 atomic % Tungsten, 20-70 atomic % Titanium, 2-35 atomic % Cobalt, and the balance Carbon and Nitrogen. These components may be evenly dispersed throughout the sintered grain growth inhibitor layer, or they may clump and aggregate as the catalyst components pass through and break apart the powder grain growth inhibitor layer during HPHT sintering.

In one embodiment, a sintered PCD material formed by the method of FIG. 1 has a uniform microstructure, meaning that it is substantially free of visible agglomerations of grain growth inhibitor that are on the size scale of the diamond crystals, and substantially free of abnormal grain growth (see FIG. 3C, showing the magnified PCD microstructure). About 95% of the sintered diamond grains are about 1 micron in size or smaller. The largest sintered diamond grains are about 5 microns or smaller, or in another embodiment about 3 microns or smaller. In another embodiment, the sintered diamond grains have an average size of about 0.5 micron, with the largest sintered diamond grain being about 1 micron.

The method described above provides a powder layer of grain growth inhibitor particles and achieves effective grain growth suppression. The ultra-fine PCD exhibits superior wear resistance and mechanical strength and performs well in cutting tool applications, such as abrasive aluminum alloy machining, graphite composite machining, and titanium machining. The PCD material may also be used in drilling, turning, and milling applications.

Figure 5:
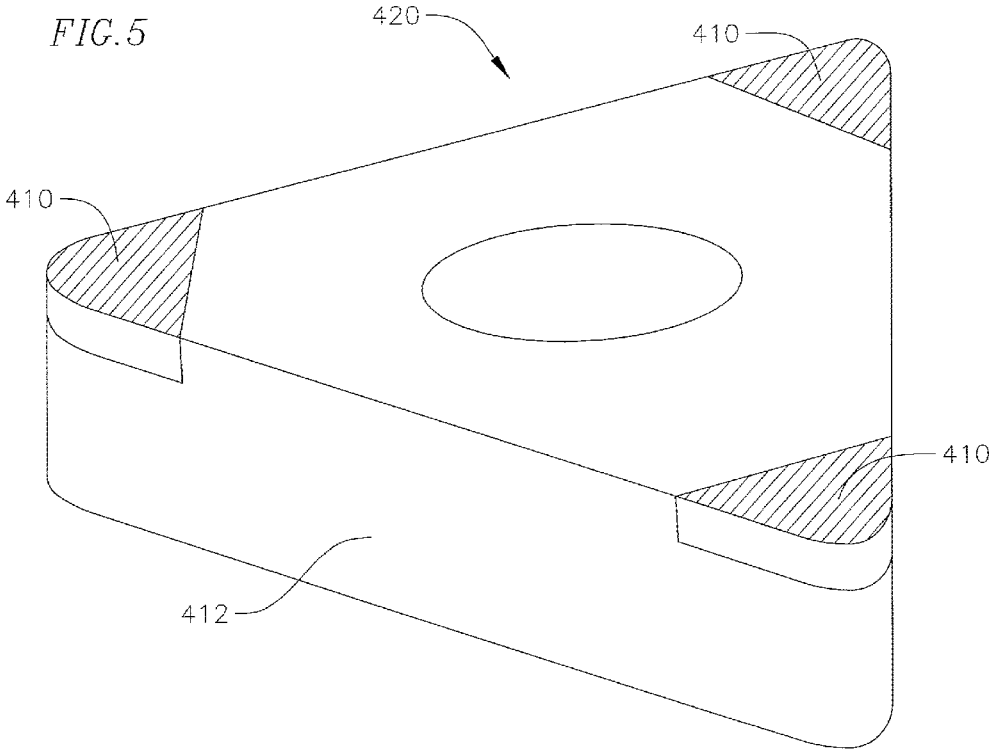
FIG. 5 shows a cutting tool insert tipped with pieces cut from an ultra-fine PCD material, according to an embodiment of the present disclosure.

FIG. 5 shows a cutting tool insert 420 tipped with pieces 410 cut from an ultra-fine PCD material, according to an embodiment of the present disclosure. The cutting insert 420 includes a cemented carbide insert body 412, and the tip pieces 410 cut from the ultra-fine sintered PCD are brazed to the body 412 at the corners of the body. The cutting insert 420 may be mounted in a machine tool for use in a cutting application such as turning or milling. The PCD tip pieces 410 of the insert 420 provide a combination of toughness and wear-resistance for superior cutting performance. In one embodiment, the ultra-fine PCD material may be incorporated into a shear cutter for drilling applications.

Although the present invention has been described and illustrated in respect to various embodiments, it is to be understood that it is not to be so limited, since changes and modifications may be made therein which are within the full intended scope of this invention as hereinafter claimed.

What is claimed is:

1. A method of fabricating a polycrystalline diamond material, comprising:

placing a powder layer of nano-sized grain growth inhibitor particles next to a mixture of diamond particles, the mixture of diamond particles having an average particle size of about 1 micron or or less, the grain growth inhibitor layer comprising a plurality of titanium-containing particles being less than 800 nanometers in size;

placing a substrate next to the powder layer; and sintering the mixture of diamond particles and the powder layer of grain growth inhibitor particles at high pressure and high temperature to create a polycrystalline structure of sintered diamond grains, wherein the sintered diamond grains have an average size of about 1 micron or or less and the grain growth inhibitor is bonded to the substrate and to the polycrystalline diamond at opposite sides and is about 20-100 microns in thickness.

2. The method of claim 1, wherein the diamond particles have an average particle size of about 0.5 micron or less.

3. The method of claim 1, wherein the powder layer of nano-sized grain growth inhibitor particles comprises a carbide, nitride, and/or carbon nitride of titanium.

4. The method of claim 1, wherein the grain growth inhibitor particles have a particle size of less than 200 nanometers.

5. The method of claim 4, wherein the grain growth inhibitor particles have an average particle size of less than 100 nanometers.

6. The method of claim 1, wherein the largest sintered diamond grains are no larger than 3 microns in size.

7. The method of claim 1, wherein the powder layer of grain growth inhibitor particles comprises a homogeneous mixture of grain growth inhibitor particles.

8. The method of claim 1, further comprising carrying a portion of the grain growth inhibitor particles into the mixture of diamond particles during sintering.

9. The method of claim 1, further comprising reducing a rate of infiltration of a catalyst from the substrate into the mixture of diamond particles during sintering.

10. The method of claim 1, further comprising partially compacting the grain growth inhibitor and the diamond particles prior to sintering, wherein the grain growth inhibitor has a density in the range of 30% to 70% of theoretical density.

11. The method of claim 1, wherein the grain growth inhibitor particles have an average particle size that is smaller than an average size particle size of said diamond particles.

12. The method of claim 1, wherein the titanium-containing particles comprise only one type of particles selected from the group consisting essentially of TiC, $TiC_xN_y$, and TiN.

13. The method of claim 1, wherein the titanium-containing particles are selected from the group consisting essentially of TiC, $TiC_xN_y$, TiN, and combinations thereof.

14. A polycrystalline diamond material manufactured by the process of claim 1.

15. A polycrystalline diamond compact comprising:

a polycrystalline diamond body comprising a material microstructure comprising a plurality of bonded-together diamond grains and interstitial regions between the diamond grains;

a substrate comprising tungsten and a catalyst metal; and a grain growth inhibitor layer between the polycrystalline diamond body and the substrate, the grain growth inhibitor layer comprising a plurality of titanium-containing particles interspersed with tungsten and the catalyst metal, wherein the titanium-containing particles are less than 800 nanometers in size, wherein the grain growth inhibitor layer is bonded to the substrate and to the polycrystalline diamond body at opposite sides, and is about 20-100 microns in thickness; and wherein the diamond grains have an average size of about 1 micron or less.

16. The polycrystalline diamond compact of claim 15, wherein the grain growth inhibitor layer comprises about 1-25 atomic % Tungsten, 20-70 atomic % Titanium, 2-35 atomic % Cobalt, and the balance Carbon and Nitrogen.

17. The polycrystalline diamond compact of claim 16, wherein the Tungsten, Titanium, and Cobalt are evenly dispersed throughout the grain growth inhibitor layer.

18. The polycrystalline diamond compact of claim 15, wherein the grain growth inhibitor layer is bonded to the substrate and to the polycrystalline diamond body at opposite sides, and is about 50-70 microns in thickness.

19. The polycrystalline diamond compact of claim 15, wherein the diamond grains have an average size of 0.5 micron or less.

20. A cutting tool comprising a tool body and at least one polycrystalline diamond compact as claimed in claim 15, disposed thereon.

* * * * *